US011554284B2

(12) United States Patent
Lanier

(10) Patent No.: US 11,554,284 B2
(45) Date of Patent: Jan. 17, 2023

(54) MOTOR POWERED LIFTING RACK SYSTEM

(71) Applicant: Cody Austin Lanier, Oklahoma City, OK (US)

(72) Inventor: Cody Austin Lanier, Oklahoma City, OK (US)

(73) Assignee: Trainsphere Holdings LLC, Colorado Springs, CO (US)

( * ) Notice: Subject to any disclaimer, the term of this patent is extended or adjusted under 35 U.S.C. 154(b) by 0 days.

(21) Appl. No.: 17/661,767

(22) Filed: May 3, 2022

(65) Prior Publication Data

US 2022/0288441 A1 Sep. 15, 2022

Related U.S. Application Data

(63) Continuation of application No. PCT/US2022/019312, filed on Mar. 8, 2022.

(60) Provisional application No. 63/200,471, filed on Mar. 9, 2021.

(51) Int. Cl.

| | |
|---|---|
| ***A63B 21/078*** | (2006.01) |
| ***A63B 21/00*** | (2006.01) |
| ***A63B 24/00*** | (2006.01) |

(52) U.S. Cl.

CPC ..... *A63B 21/078* (2013.01); *A63B 21/4029* (2015.10); *A63B 24/0062* (2013.01); *A63B 24/0087* (2013.01); *A63B 2210/56* (2013.01); *A63B 2220/807* (2013.01); *A63B 2225/093* (2013.01); *A63B 2225/096* (2013.01)

(58) Field of Classification Search

CPC ..... A63B 21/078; A63B 21/4029; A63B 24/0062; A63B 24/0087; A63B 2210/56; A63B 2220/807; A63B 2225/093; A63B 2225/096

See application file for complete search history.

(56) References Cited

U.S. PATENT DOCUMENTS

| | | | | |
|---|---|---|---|---|
| 4,253,662 A | | 3/1981 | Podolak | |
| 4,540,171 A | | 9/1985 | Clark et al. | |
| 4,826,157 A | * | 5/1989 | Fitzpatrick ..... | A63B 21/4029 482/99 |
| 4,974,838 A | | 12/1990 | Sollenberger | |
| 5,823,921 A | | 10/1998 | Dawson | |

(Continued)

FOREIGN PATENT DOCUMENTS

| | | | | |
|---|---|---|---|---|
| CN | 109011343 A | * | 12/2018 | ..... A63B 21/008 |
| CN | 110812779 A | * | 2/2020 | |
| WO | WO-2016205883 A1 | * | 12/2016 | ..... A63B 1/00 |

OTHER PUBLICATIONS

International Search Report and Written Opinion; PCT/US22/19312; dated Jun. 13, 2022.

*Primary Examiner* — Sundhara M Ganesan
(74) *Attorney, Agent, or Firm* — Dunlap Bennett & Ludwig, PLLC

(57) ABSTRACT

A motorized lifting rack that selectively lifts and lowers a barbell through linear actuators is provided. The powered lifting rack can engage a barbell at floor level. The linear actuators can also selectively raise and lower safety bars design to "spot" the barbell for a single user. The powered lifting rack is embodied in a system that includes a platform that the safety bars can nest in. The platform provides a plurality of actuating benches for a user of the barbell to utilize.

14 Claims, 13 Drawing Sheets

(56) References Cited

U.S. PATENT DOCUMENTS 6,558,299 B1 5/2003 Slattery
6,685,601 B1 * 2/2004 Knapp ..... A63B 21/0783 482/142
6,821,288 B2 11/2004 Schaeffer
6,893,381 B2 5/2005 Slawinski
6,926,649 B2 8/2005 Slawinski
7,001,314 B1 * 2/2006 Hummer, Jr. ..... A63B 21/078 482/94
7,374,515 B2 5/2008 Slawinski et al.
7,488,277 B1 * 2/2009 Knapp ..... A63B 21/0626 482/106
7,578,774 B1 * 8/2009 Zetterberg ..... A63B 1/00 482/92
8,057,368 B1 * 11/2011 Lyszczarz ..... A63B 21/156 482/142
8,900,097 B1 * 12/2014 Griggs ..... A63B 21/4043 482/4
9,168,412 B2 10/2015 Towley, III et al.
9,327,160 B2 5/2016 Tauriainen
9,327,161 B1 * 5/2016 Maher ..... A63B 21/078
9,492,701 B1 * 11/2016 Bognatz ..... A63B 21/072
9,555,309 B1 * 1/2017 LaBar ..... A63B 21/0724
9,609,911 B1 * 4/2017 Walsh ..... A43B 3/34
9,707,435 B1 * 7/2017 Ferlito ..... A63B 21/28
10,022,591 B2 7/2018 Back et al.
10,456,614 B1 * 10/2019 Dube ..... A63B 24/0062
10,561,882 B2 2/2020 Baek et al.
10,639,515 B2 * 5/2020 Simmons ..... A63B 23/0464
10,646,740 B2 5/2020 Lee
10,843,041 B1 * 11/2020 Cobb ..... A63B 23/03525
11,007,400 B1 * 5/2021 Stoddard ..... A63B 21/151
11,058,936 B1 * 7/2021 Brasch ..... A63B 23/1218
11,202,951 B1 * 12/2021 Augustin ..... G06F 3/011
2005/0239612 A1 * 10/2005 Keiser ..... A63B 21/0724 482/94
2006/0063650 A1 * 3/2006 Francis ..... A63B 21/4047 482/94
2007/0072750 A1 3/2007 Andrews
2007/0179030 A1 8/2007 Slawinski
2008/0070759 A1 * 3/2008 Chaulk ..... A63B 21/078 482/104
2009/0105052 A1 * 4/2009 Dalebout ..... A63B 21/06 482/133
2009/0203505 A1 * 8/2009 Kroll ..... A63B 21/078 482/104
2011/0172066 A1 7/2011 Roppolo
2012/0058859 A1 3/2012 Elsom-Cook et al.
2013/0012359 A1 1/2013 Hanoun
2013/0184128 A1 * 7/2013 Towley, III ..... A63B 21/0615 482/102
2013/0252216 A1 9/2013 Clavin et al.
2014/0213414 A1 * 7/2014 Balandis ..... A63B 21/169 482/111
2014/0296040 A1 10/2014 Mobley
2015/0290487 A1 * 10/2015 Dixon ..... A63B 22/16 482/142
2015/0306485 A1 * 10/2015 Gluchowski ..... A63B 21/0783 482/92
2015/0375033 A1 * 12/2015 Lanfranco ..... A63B 21/078 482/94
2016/0038088 A1 * 2/2016 Lari ..... A61B 5/11 600/595
2016/0310776 A1 * 10/2016 Smith ..... A61H 33/06
2017/0028246 A1 * 2/2017 Vorozilchak ..... A63B 21/4029
2017/0050102 A1 * 2/2017 Kelly ..... G07C 9/00904
2017/0239512 A1 * 8/2017 Brasch ..... A63B 21/4029
2017/0326401 A1 * 11/2017 Durket ..... A63B 23/0405
2018/0229072 A1 * 8/2018 Staten ..... A63B 21/4029
2018/0296872 A1 * 10/2018 English ..... A63B 21/4029
2020/0023227 A1 * 1/2020 Gore ..... A63B 21/156
2020/0047055 A1 * 2/2020 Ward ..... A61B 5/6895
2020/0101342 A1 * 4/2020 Lawton ..... A63B 21/4033
2020/0111384 A1 * 4/2020 Bell ..... G09B 5/02
2020/0139187 A1 * 5/2020 Kennington ..... A63B 71/0622
2020/0215393 A1 * 7/2020 Blackwell ..... A63B 24/0075
2020/0254295 A1 8/2020 Watterson
2020/0254309 A1 8/2020 Watterson
2020/0338384 A1 * 10/2020 Rindfleisch ..... A63B 21/078
2020/0376318 A1 * 12/2020 Durket ..... A63B 23/0405
2020/0376321 A1 * 12/2020 Davis ..... A63B 21/0724
2021/0077884 A1 * 3/2021 De las Casas Zolezzi ..... A63B 71/0054
2021/0128970 A1 * 5/2021 Grissel, Jr. ..... A63B 21/078
2021/0138332 A1 * 5/2021 Dalebout ..... E05F 15/60
2021/0205688 A1 * 7/2021 Liao ..... A63B 71/0622
2021/0228935 A1 * 7/2021 Duplechain ..... A63B 21/151
2021/0375425 A1 * 12/2021 Zhang ..... A63B 21/169
2021/0394011 A1 * 12/2021 Neuhaus ..... A63B 21/002
2022/0062738 A1 * 3/2022 Neuhaus ..... A63B 21/0058
2022/0134171 A1 * 5/2022 LoDuca ..... A63B 21/063 482/99
2022/0233907 A1 * 7/2022 Cobb ..... A63B 21/078
2022/0233908 A1 * 7/2022 Neuhaus ..... A63B 21/0783

* cited by examiner

MOTOR POWERED LIFTING RACK SYSTEM

CROSS-REFERENCE TO RELATED APPLICATION

This application claims the benefit of priority of U.S. provisional application No. 63/200,471, filed 9 Mar. 2021, the contents of which are herein incorporated by reference.

BACKGROUND OF THE INVENTION

Every environment is a resource constrained environment, and the gym environment is no exception. An example of some but not all the constrained resources at the gym are as follows. Equipment resources such as barbells, weights for the barbells, squat racks, lifting platforms, power racks, benches, dumbbells, other exercise devices or machines and space needed for the equipment. Personnel resources such as personal trainers and people who can "spot" you in the gym. Additionally, the amount of time you have while at the gym (this includes setting up and taking down the equipment as well as waiting for the equipment to be available) and the money you have for your training programs and memberships are additional limited resources. Most equipment available today is inefficient at maximizing those limited resources.

Most multi-purpose equipment such as the power rack is insufficient at maximizing those limited resources. Some but not all the inefficiencies of the power rack are as follows. Even though the power rack is multi-purpose many power racks can only be used effectively by one user at a time. Most power racks hold a barbell on two J-hooks (or similar devices that a barbell is placed on to facilitate use of the power rack). This barbell is not secured on the J-hooks, which are positioned in a series of vertical pinholes placed along space apart frame members. As a result, users of most power racks need to manually adjust the height of the J-hooks by, first removing the barbell (if not already placed), then pulling the J-hooks out of the frame members, and then placing two J-hooks in one of a series of vertical pinholes in the space apart frame members so that they properly align with each other. If the power rack has safety bars (or safety pins, straps or other similar devices), they too must be manually adjusted the same way as the J-hooks.

Additionally, since the barbell is not secured in place, completely loading one side of the barbell before loading the other side is difficult and dangerous because the barbell may tip over and fall off the J-hooks and land on someone when it is being loaded unevenly from high off the ground. In short, users cannot load large weights on one side of the barbell before loading the other side because nothing is securing the barbell on the J-hook and the barbell could tip over.

Accordingly, most power racks are inefficient when adjusting the height of the barbell on J-hooks, safety pins/bars and/or changing the weights on the barbell—which is amplified by the fact that each power rack in a gym will have dozens of users over the course of each day. Therefore, different users must continuously change the height of the barbell and safety pins/bars in addition to changing the weight on the barbell before they can start just their first routine. Then they may have to do it again for each following routine.

Additionally, most power racks may have users manually place a bench (or other similar device) for bench presses (or other similar movements) that must be moved into and out of position for those lifts so other users can use the power rack without the bench. This makes it additionally inefficient at training one or more people with the same barbell who need to use similar weight but for different lifts. Additionally, most power racks may have users manually place lifting blocks (or other similar device) to perform barbell movements from higher starting positions on the power rack. This manual process of moving and repositioning the lifting blocks is inefficient at maximizing the number of people that can train with the equipment and/or minimizing the amount of time of people who need to do various barbell movements on the same power rack using the same barbell.

Additionally, most power racks may make it difficult to train multiple people even if they are using similar weight on the barbell. For example, the power rack may be configured for a user to squat two hundred and twenty-five pounds but even though a second user needs to deadlift two hundred and twenty-five pounds and a third user needs to bench two hundred and twenty-five pounds, there may be no way to effectively reconfigure the equipment to do those lifts on the same power rack within a few seconds of each other using the same barbell. The users in that example would have to manually unload/load the barbell, reconfigure the power rack for each movement and that process is inefficient.

Furthermore, most power racks may not have a real time active "spotting" system (similar to how users would "spot" each other) for users during their sessions and/or train them how to lift the weight with proper technique. This increases the risk of injury to users who do not know how to lift weight with proper technique and/or know how to properly configure the equipment. Additionally, most power racks are incapable of lifting an unloaded or loaded barbell (or other loads) to an operable height from floor level for a user who does not have the strength or mobility to do it themselves.

There is a need for a system that may help minimize one's time in the gym, minimize the amount of space needed for training equipment, maximize the number of people that can train at the gym and reduce the risk of injury during training. A system that may help the gym to be more profitable and cost effective for the gym owner, investor, as well as for users training with the present invention.

SUMMARY OF THE INVENTION

Broadly, an embodiment of the present invention provides a system that selectively lifts and lowers a barbell through linear actuators. The system can engage an unloaded barbell at floor level. The linear actuators can also selectively raise and lower safety bars to "spot" the barbell for a single user. The present invention is embodied in a system that includes a platform that the safety bars and actuating benches can nest in. The platform provides a plurality of actuating benches for a user of the barbell to utilize. The actuating benches on the outside of uprights can additionally "spot" the barbell and tilt to roll the barbell along the platform to reposition it for lifts on the floor or back to the bar supports and can deflect a dropped barbell away from the lifter.

Specifically, a system that selectively actuates the barbell on J-hooks, safety bars, side and central actuating benches between the floor and an operable height, wherein the J-hooks for the barbell to rest on and/or safety bars are provided with latches. The present invention relates to free weight training systems and, more particularly, may be a motor-powered lifting rack system that selectively lifts and lowers a barbell through linear actuators. The motor-powered lifting rack system can engage an unloaded barbell at floor level. The linear actuators can also selectively raise and lower safety bars to "spot" the barbell for a single user. The present invention is embodied in a system that includes a platform that the safety bars and actuating benches can nest in. The platform provides a plurality of actuating benches for a user of the barbell to utilize. The actuating benches on the outside of uprights can additionally "spot" the barbell and tilt to roll the barbell along the platform to reposition it for lifts on the floor or back to the bar supports and can deflect a dropped barbell away from the lifter.

The motor-powered lifting rack system embodied in the present invention makes it more efficient and precise to adjust the height of the side and central actuating benches, the J-hooks, and safety bars with or without a barbell and with or without weight on the barbell. It also secures the barbell on the J-hooks or in a notch in the safety bars with bar locks/latches for more efficient loading and unloading of weight. The overall system enables a user to selectively lift, through linear actuators, the barbell from a ground level via the J-hooks, the safety bars or the side actuating benches. It also is more efficient at maximizing the number of people using the equipment because multiple people can perform different barbell exercises while using the same weight. For example, someone benches two hundred and twenty-five pounds and someone else needs to deadlift two hundred and twenty-five pounds. After the person benches two hundred and twenty-five pounds the present invention can lower the bench and lower the barbell that is on the J-hooks to floor level. Then it can reposition the barbell to the middle of the platform by tilting the outside benches and rolling the barbell into place for the other person to deadlift two hundred and twenty-five pounds. The process is easily reversed after the deadlift so that the original person can bench two hundred and twenty-five pounds again.

Additionally, the motor-powered lifting rack system embodied in the present invention reduces the risk of injury by having a redundant spotting system to effectively "spot" users during their training sessions. This spotting system has a faster reaction time than human spotters and can "spot" far heavier weight that a normal human can. The present invention further reduces the risk of injury by training users how to properly lift the weight and reduces the risk of injury to other bystanders by having a command-and-control system to keep the barbell on the system, even when the barbell is accidentally or intentionally dropped on the system.

In one aspect of the present invention, a lifting rack includes a plurality of uprights; at least one linear actuator housed in each upright; a motor powering each linear actuator; for each upright, an interface extends along a length of the upright; and for each linear actuator, a support transition operatively associates a bar support and at least one linear actuator so that the bar support is selectively movable along the interface.

In another aspect of the present invention, the motor powered lifting rack system include the following: a platform, wherein a proximal end of each upright connects to the platform; the platform having a first actuating bench disposed between the plurality of uprights, wherein the motor is operatively associated with the first actuating bench in such a way that the first actuating bench is selectively movable between an extended position and a retracted position, wherein the retracted position an upper surface of the first actuating bench is approximately flush with an upper surface of the platform; the platform having at least one second actuating bench disposed outside of the plurality of uprights, wherein the motor is operatively associated with at least one second actuating bench in such a way that the second actuating bench is selectively movable between an extended position and a retracted position, wherein the retracted position an upper surface of the second actuating bench is approximately flush with an upper surface of the platform, wherein the at least one linear actuator includes a support actuator and a safety actuator oriented in parallel, wherein the support actuator operates with the support transition, wherein the safety actuator operatively associated with a safety bar so that the safety bar is selectively movable between a nested condition and an elevated condition, wherein the platform provides a recess dimensioned to receive the safety bar in the nested condition so that an upper portion of the safety bar is flush with the upper surface of the platform; a safety transition operatively associated the safety actuator and a distal end of the safety bar, wherein the safety transition is U-shaped at the distal end and loop shaped at the proximal end, and wherein the support transition is loop shaped, wherein a distal end of the safety bar has a cavity dimensioned to slidably receive the bar support so that the bar support is at least substantially received in the cavity when the safety transition and the support transition are at a shared elevation relative to the platform, wherein each bar support has a basket, and having a basket latch connected with the basket in such a way to pivot between a closed position and an open position, wherein safety bar has a notch, and wherein each notch has notch latch connected with the notch in such a way to pivot between a closed position and an open position; a plurality of cross members interconnecting each distal end of the plurality of uprights; and the motor disposed in the cross members; and a plurality of cameras and at least one computer connected with the plurality of uprights or the plurality of cross members.

In yet another embodiment of the present invention, a lifting rack system includes each second actuating bench is operatively associated with a bench actuator in such a way as to be selectively movable across a plurality of tilted orientations, wherein an upper surface of the second actuating is lockable in each tilted orientation defining an angle of incident relative to the platform, wherein the angle of incident selectively ranges between zero and forty-degrees.

In an additional embodiment of the present invention, a lifting rack system includes the following: a platform; and at least one image capturing device coupled with at least one computer operatively associated with the lifting rack system, wherein the at least one computer is configured to provide a feedback regarding a user of the lifting rack system performing an exercise, wherein the feedback is a wireframe model of said user during the exercise, wherein the wireframe model includes a plurality of nodes, wherein each node represents a body portion of said user, wherein the at least one computer is configured to determine one or more reference angles between a respective body portion and the platform during the exercise; and further including the following: a plurality of uprights supported by the platform; at least one linear actuator housed in each upright; a motor powering each linear actuator; for each upright, an interface extends along a length of the upright; for each linear actuator, a support transition operatively associates a bar support and the at least one linear actuator so that the bar support is selectively movable along the interface; and a fitness tool operatively associated with one or more of the bar supports, wherein the computer is configured to access a database of exercise routines and, based in part on a first comparison between the database and the wireframe model, selectively activate the motor to move at least one linear actuator; and further including an actuating bench disposed between the plurality of uprights, wherein the motor is operatively associated with the actuating bench in such a way that the actuating bench is selectively movable between an extended position and a retracted position, wherein the computer is configured to, based in part on a second comparison between the database and the wireframe model, selectively activate the motor to move the actuating bench.

These and other features, aspects and advantages of the present invention will become better understood with reference to the following drawings, description and claims.

DETAILED DESCRIPTION OF THE INVENTION

Figure 1:
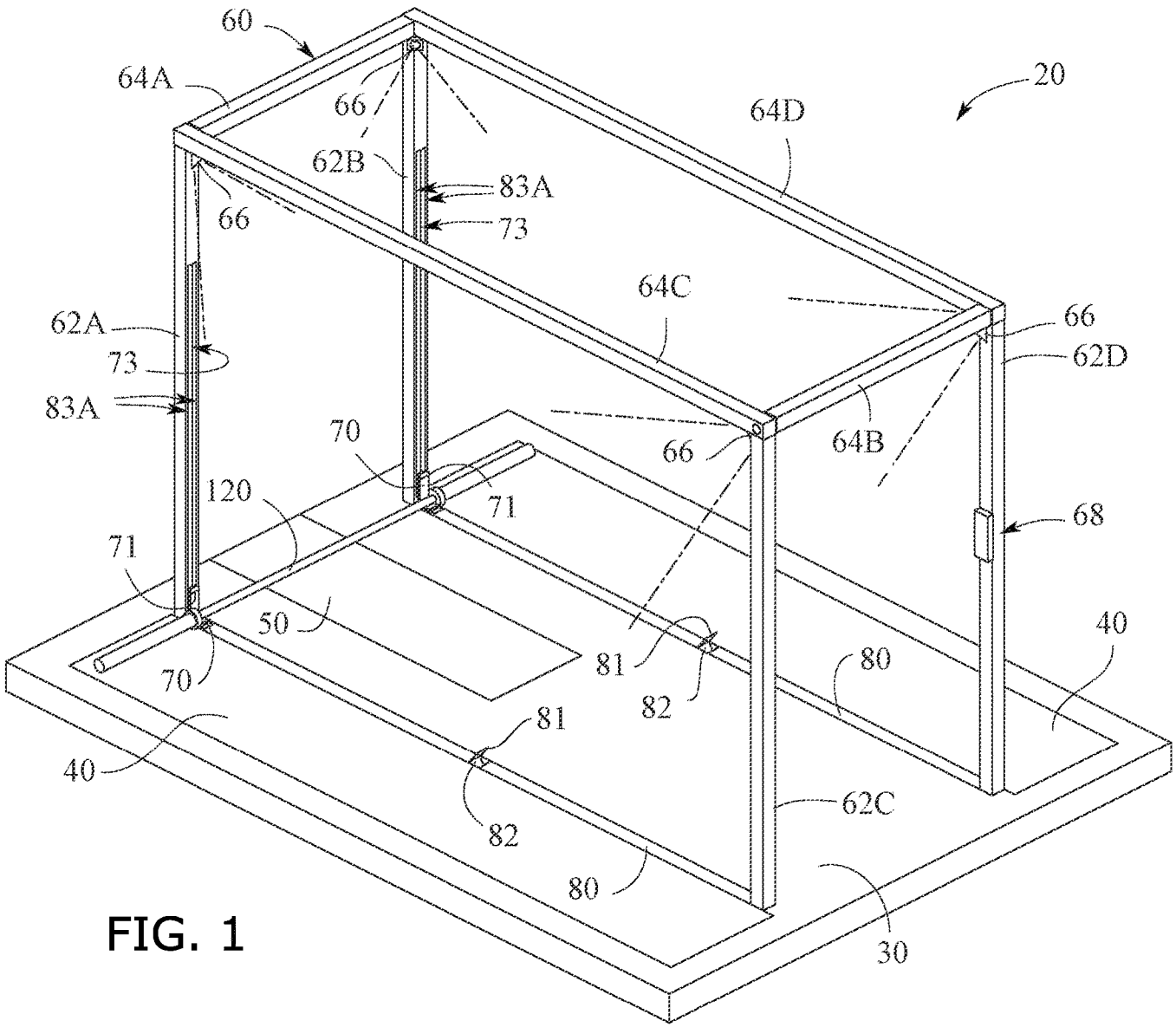
FIG. 1 is a perspective view of an exemplary embodiment of the present invention.
Figure 2:
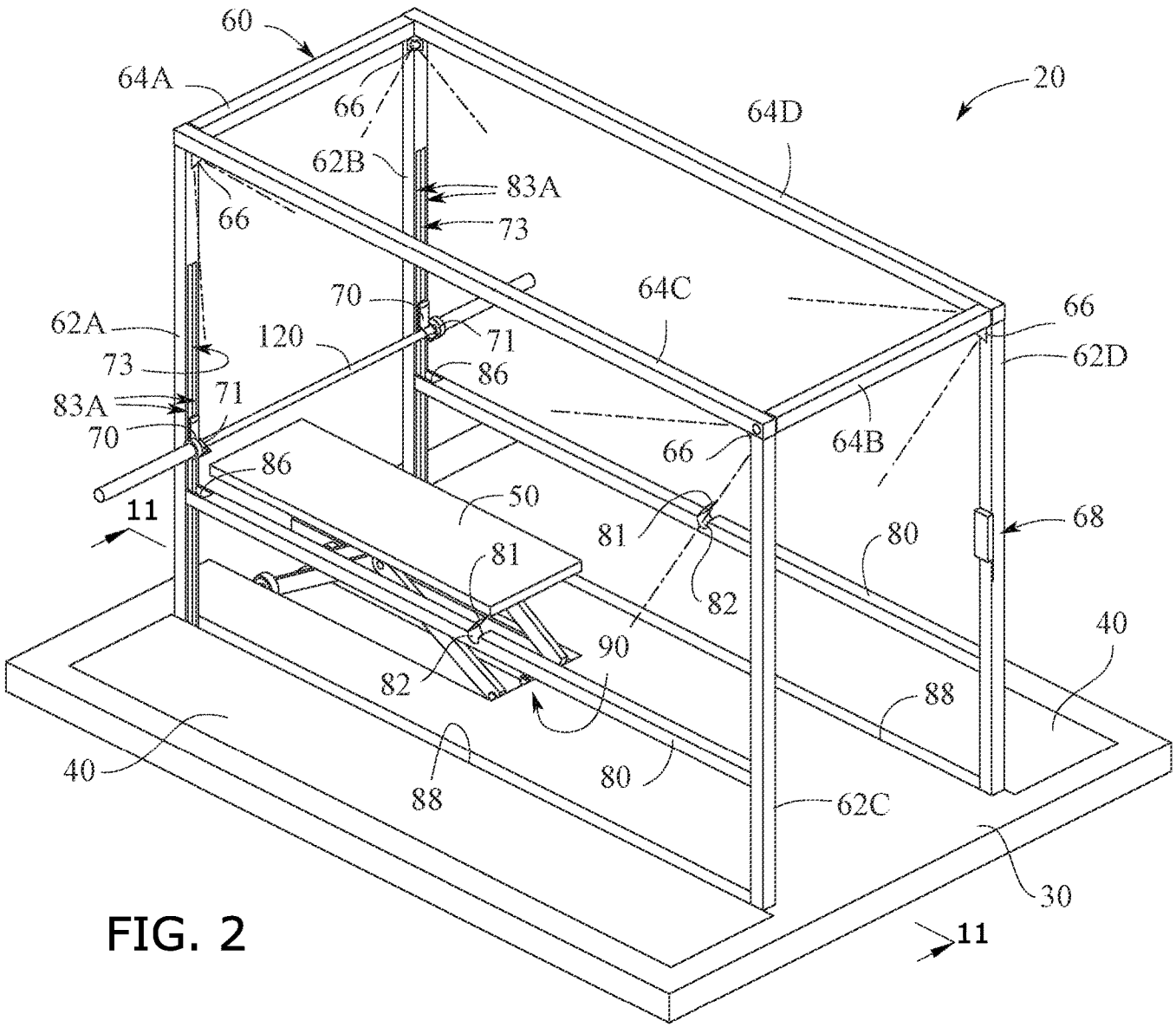
FIG. 2 is a perspective view of an exemplary embodiment of the present invention, illustrating deployment of a central actuating bench and safety bars.
Figure 3:
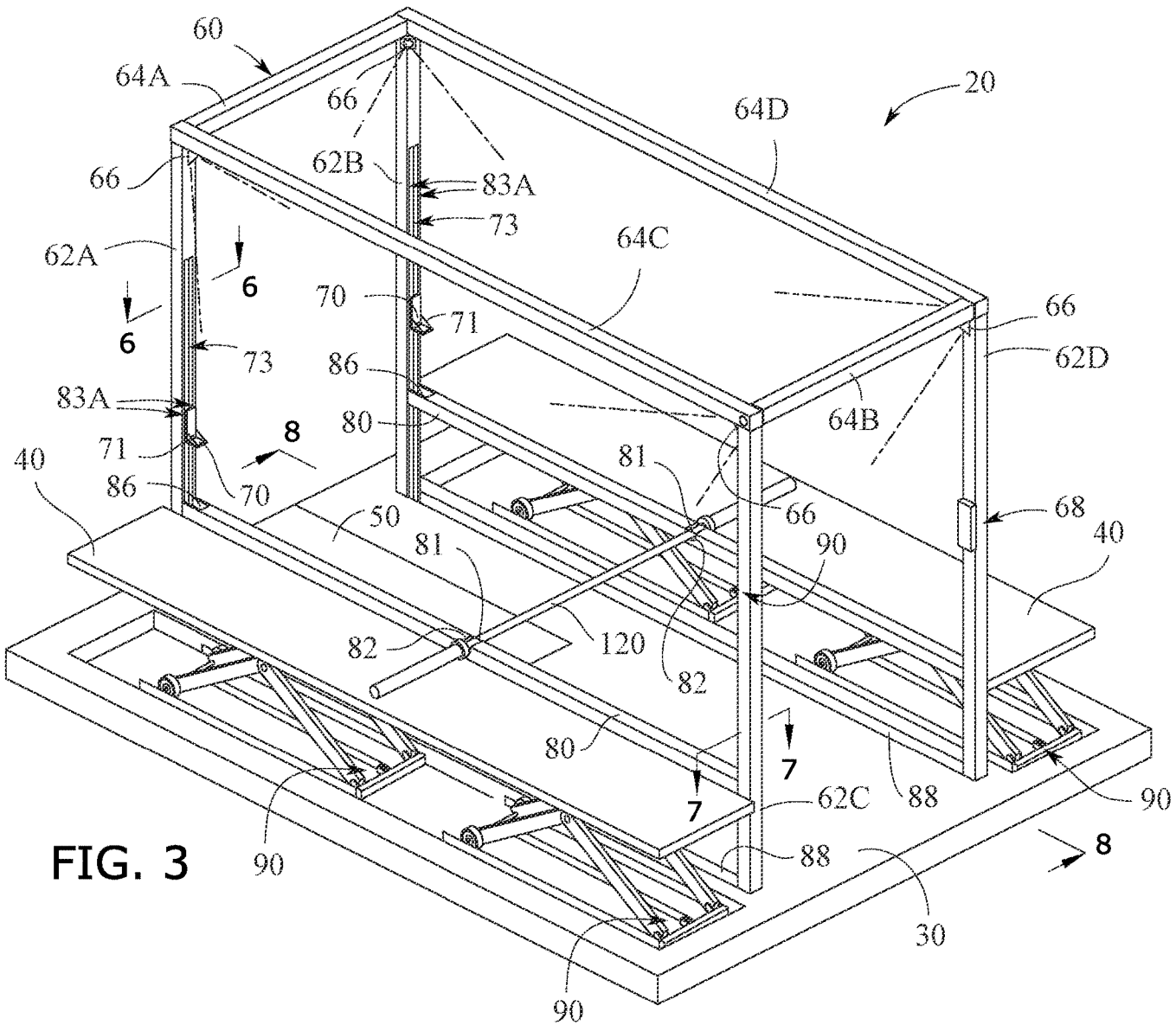
FIG. 3 is a perspective view of an exemplary embodiment of the present invention, illustrating deployment of the side actuating benches.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring now to FIGS. 1 through 13, the following is an itemized reference number list for the Figures. Any assumed quantities and the naming convention used for the following references of the current embodiment of the invention is not limiting but for the reader to understand the best currently contemplated modes of carrying out exemplary embodiments of the present invention.

20 motor powered lifting rack system (or "system"), 30 platform, 40 side actuating bench, 50 central bench, 55 adjustable bench, 60 frame, 62A-62D uprights, 64A-64D crossmembers, 66 camera, 68 computer, 70 bar support, 70A bar support transition, 70B actuator, 70C worm gear, 70D worm screw, 70E worm screw shaft, 70F drive shaft, 71 bar support latch, 72 basket, 73 interface, 74 motor, 80 safety bar, 80A safety bar transition, 80B actuator, 80C bevel and worm gear, 80D worm screw, 80E worm screw shaft, 80F drive shaft, 80G bevel gear, 80H bevel gear shaft, 801 bevel gear, 80J actuator, 80K safety bar transition, 81 safety bar latch, 82 safety bar notch, 83A-B interfaces, 84 motor, 86 safety bar cavity, 88 safety bar recess, 90 scissor lifting actuator, 100 camera frame, 110 lifter, 112 outline, 114 wire model, 116 reference angle, 120 barbell and 121 weight plate. Additionally, 80A1-2 are distal and proximal ends of 80A, 80K1-2 are distal and proximal ends of 80K, and 70A1-2 are the distal; and proximal ends of 70A.

Referring now to FIGS. 1 through 12, the present invention may include a system 20. The system 20 may include a frame 60 having four vertical uprights 62A-62D that extend from a platform 30. Four horizontal members 64A-64D may interconnect the distal ends of the vertical uprights 62A-62D, as illustrated in FIGS. 1 through 5 and FIG. 12.

The platform 30 may be dimensioned and adapted to secure the vertical uprights 62A-62D along a supporting surface. The platform 30 may provide a safety bar recess 88 extending between each pair of longitudinal uprights (e.g., 62A and 62C is one pair of longitudinal uprights). Each safety bar recess 88 is dimensioned to receive a safety bar 80 operatively associated with the respective pair of longitudinal verticals uprights in a nested condition. In the nested condition an uppermost portion of said safety bar 80 is approximately flush with an upper surface of the platform 30.

Each safety bar 80 may provide a safety bar notch 82 for receiving a portion of a barbell 120. A latch 81 may close off an upper portion of the safety bar notch 82, thereby preventing a received portion of the barbell 120 from being lifted out of the notch 82. In the nested condition, the safety bar notch 82 may occupy a space below the upper surface of the platform 30. Therefore, a barbell 120 being supported by the platform 30 and/or side actuating benches 40 may be engaged by the notch 82 as the safety bar 80 moves from the nested condition to an elevated condition between the platform 30 and/or side actuating benches 40 and the distal ends of the associated pair longitudinal uprights 62A-62C and 62B-62D, respectively.

Figure 9:
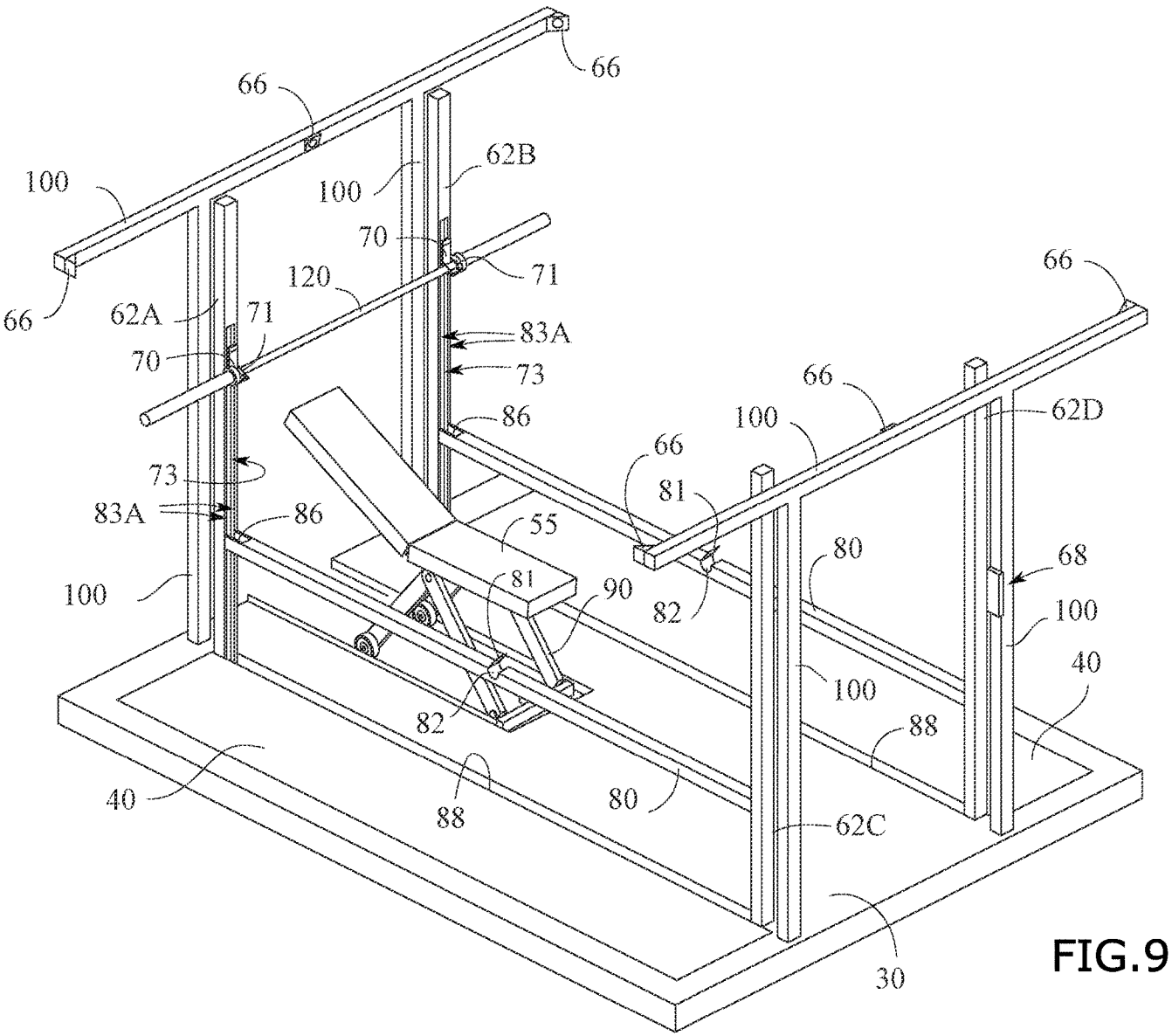
FIG. 9 is a perspective view of an alternative embodiment of the present invention.
Figure 11:
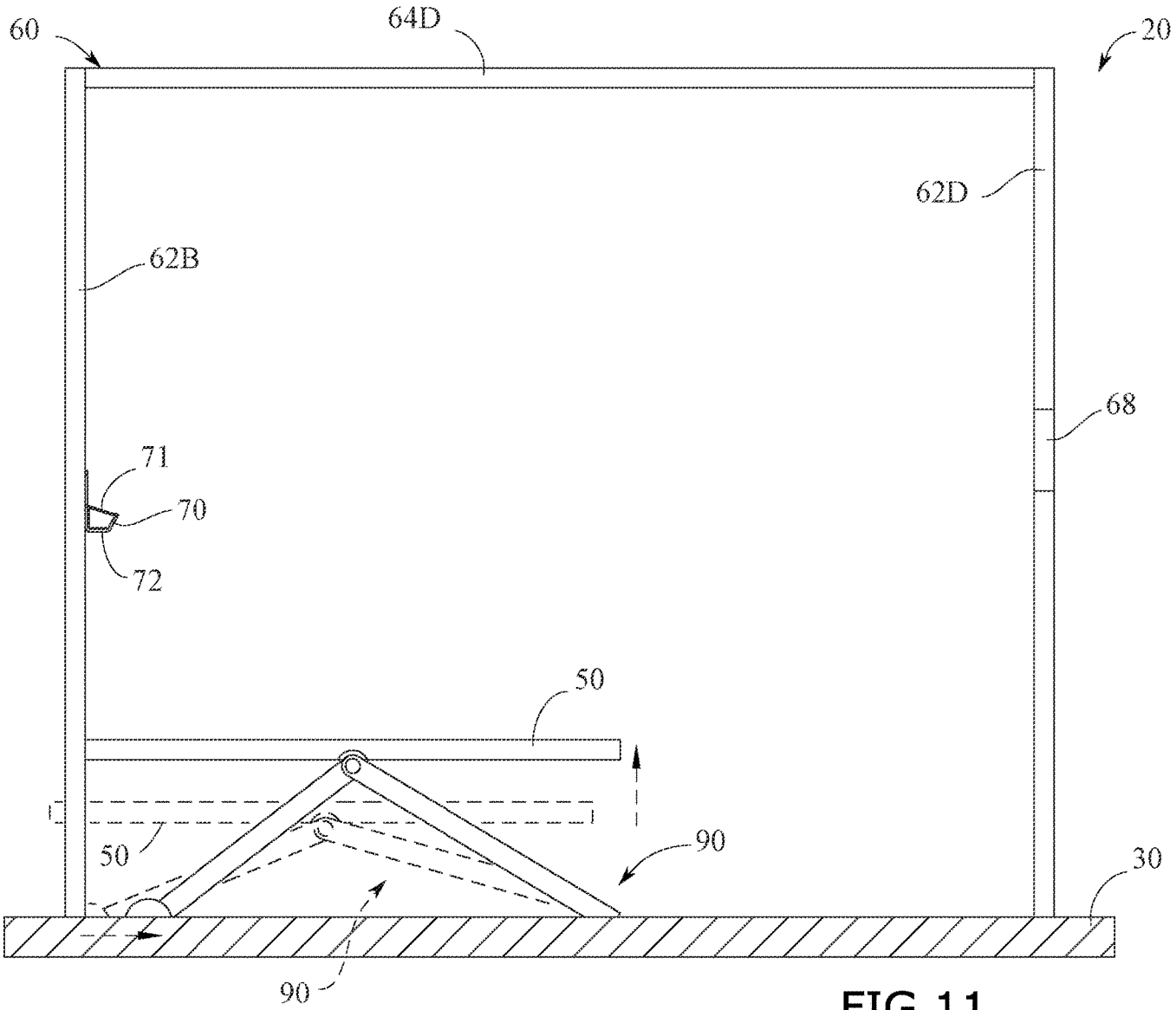
FIG. 11 is a section view of an exemplary embodiment of the present invention, taken along line 11-11 in FIG. 2, illustrating deployment of the central actuating bench, with parts removed for clarity.
Figure 12:
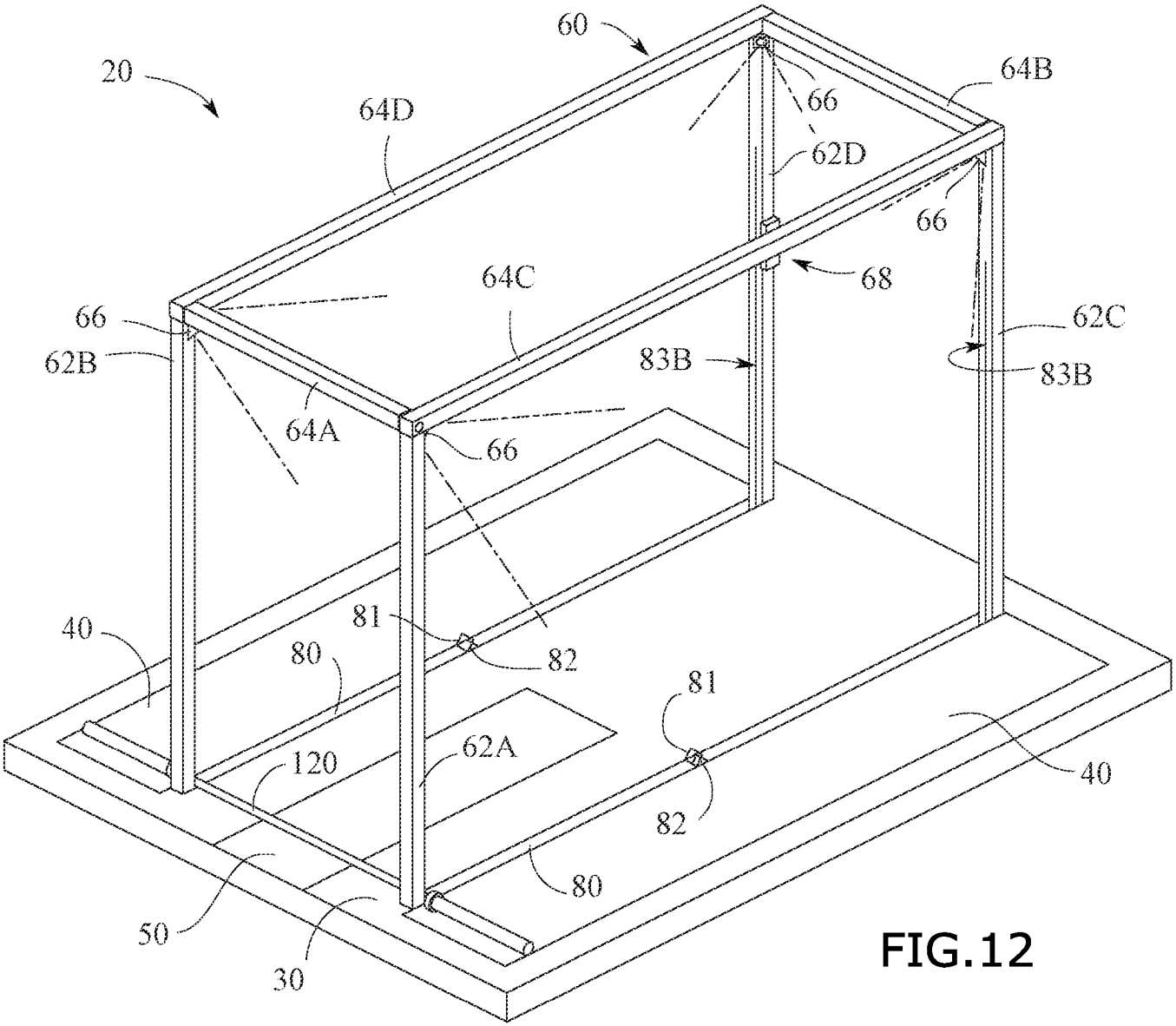
FIG. 12 is a perspective view of an exemplary embodiment of the present invention.

The platform 30 may provide a central actuating bench 50 disposed between the two pairs of longitudinal uprights and disposed adjacent to a first pair of latitudinal uprights (e.g., 62A and 62B are a pair of latitudinal uprights). The central actuating bench 50 is movable between a retracted position (see FIG. 1) and an extended position (see FIGS. 2 and 11). In the retracted position, an upper surface of the central actuating bench 50 is flush with an upper surface of the platform 30. In the extended position the central actuating bench 50 is adapted to accommodate a recumbent human user. The central actuating bench 50 may have scissor lift actuator 90 or other actuation mechanism for moving the central actuating bench 50 between the retracted and extended positions, wherein the actuation mechanics are powered by the present invention as shown in FIG. 11. The central actuating bench 50 may be adapted to be an adjustable bench 55 as shown in FIG. 9. These adaptations are for seated incline, decline or flat bench presses or other similar movements. It is understood that the central actuating bench 50 may not be located between the uprights 62A-D (as shown in FIGS. 1-3 and 12). Such as but not limited to being mounted on the outside edge of the platform 30 between the uprights 62A-D, elsewhere on the system 20 or on a wall mounted device separate and next to the system 20 and may be lower/raised/pivoted, etc. into position for bench presses or other similar movements and when stored away is not in the way of the users to do other movements on the system 20.

Figure 8:
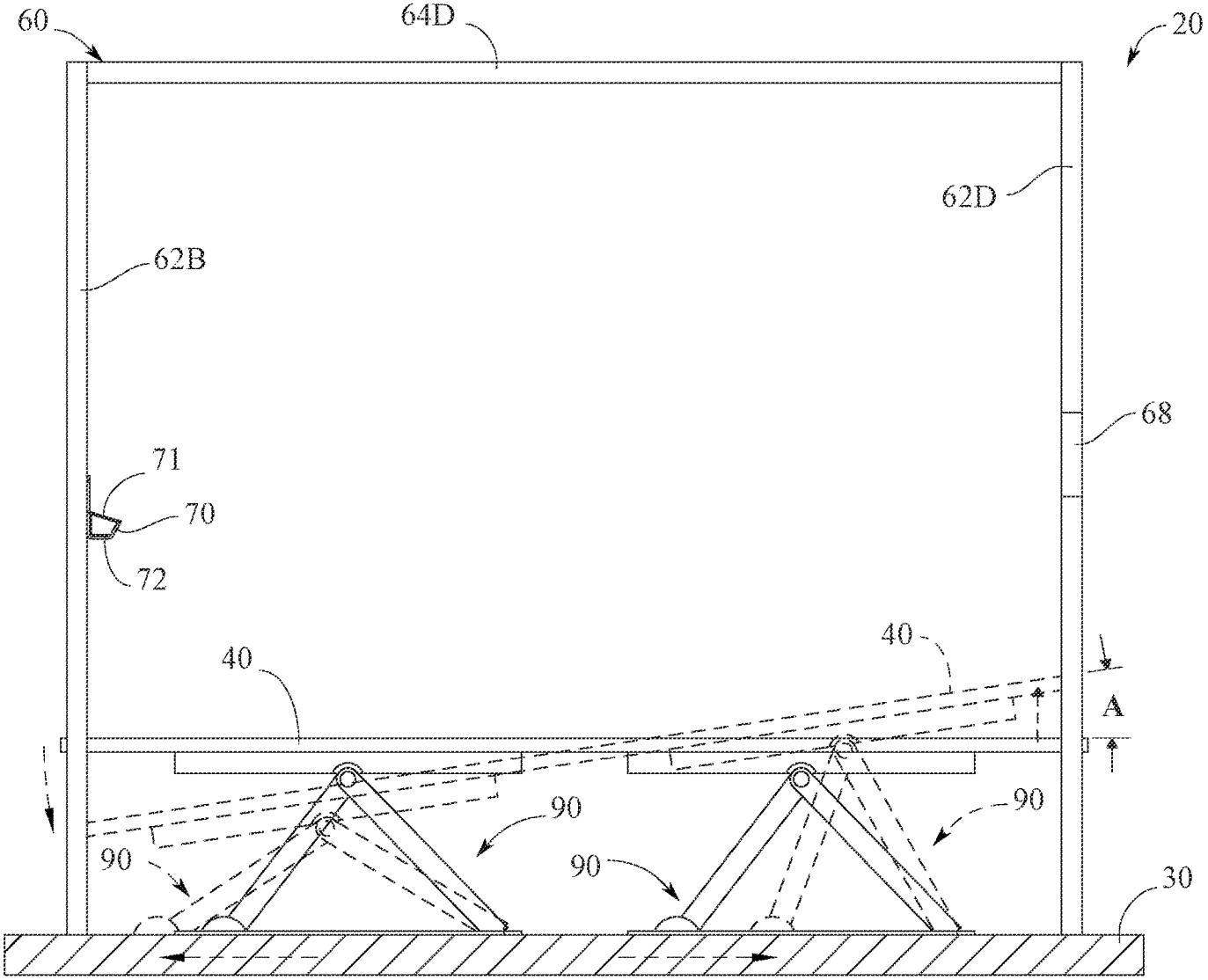
FIG. 8 is a section view of an exemplary embodiment of the present invention, taken along line 8-8 in FIG. 3, illustrating deployment of the tilt function of the side actuating benches, with parts removed for clarity.

The platform 30 may provide a side actuating bench 40 disposed to the outside of each pair of longitudinal uprights. Each side actuating bench 40 is movable between a retracted position (see FIG. 1) and an extended position (see FIG. 3 and FIG. 8). In the retracted position, an upper surface of each side actuating bench 40 is flush with an upper surface of the platform 30. In the extended position the side actuating bench 40 is adapted to accommodate one or more recumbent human users. Each side actuating bench 40 may have scissor lift actuator 90 or other actuation mechanism for moving between the retracted and extended positions, wherein the actuation mechanics are powered by the system 20. The side actuating benches 40 may be adapted to lock in a tilted position, as illustrated in FIG. 8 providing an angle of incident CA' between the upper surface of the bench 40 and the platform 30. The angle of incidence A may also be determined relative to a plane parallel with the platform 30, wherein this parallel plane is associated with an initial, non-tilted orientation/position of the upper portion/surface of the bench, as illustrated in FIG. 8. The angle of incidence A can range from zero degrees (parallel with the platform) to any angle afforded by the upper portion of the actuating bench (at some point it may contact the platform 30). In some embodiments, the angle of incidence may be ninety degrees or more based on the topology of the platform and actuating bench. This is for rolling the barbell 120 up and down the platform 30 to reposition it for other lifts as well as deflecting a dropped barbell away from the user.

Figure 4A:
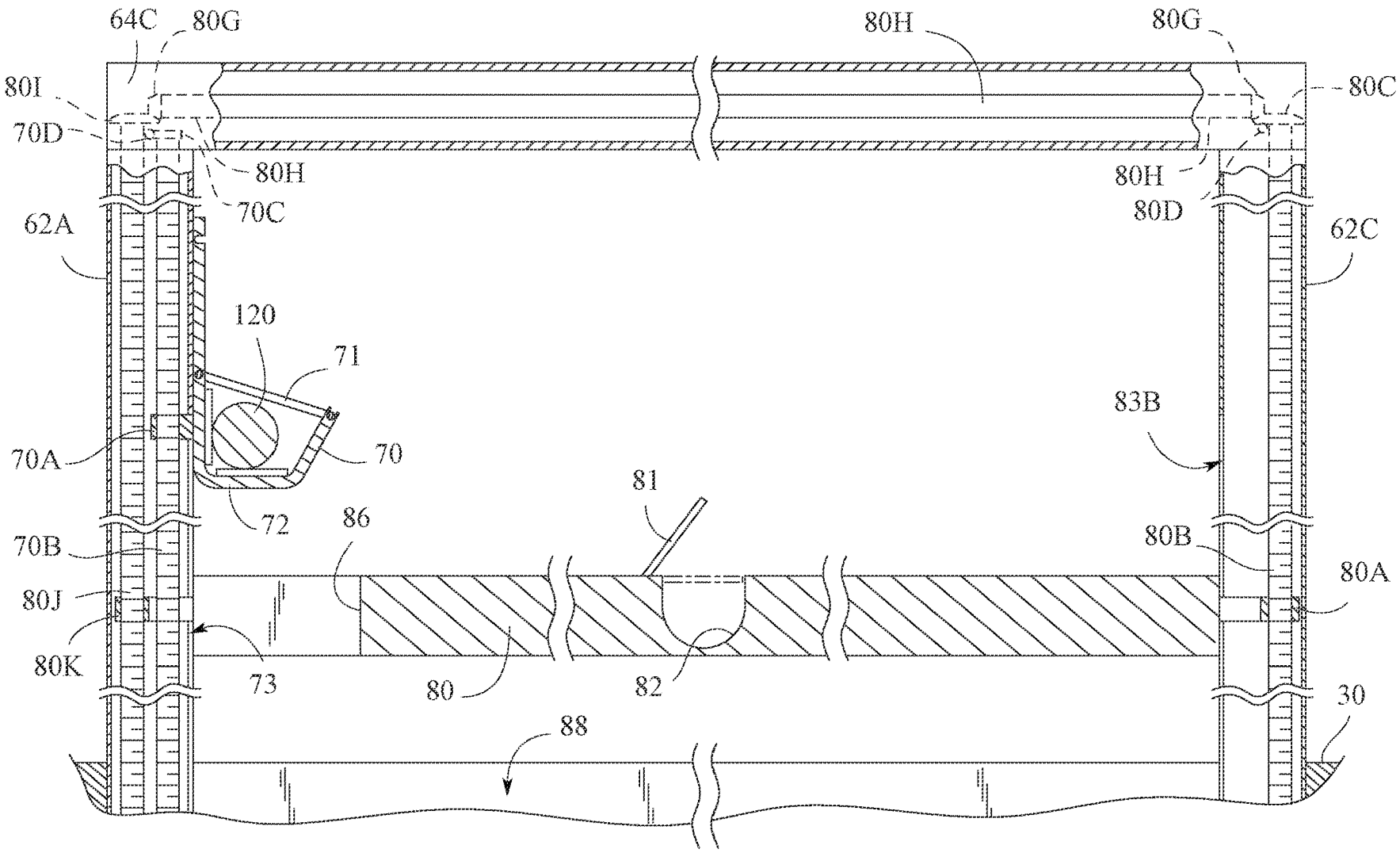
FIG. 4A is a side elevation view of an exemplary embodiment of the present invention, with parts broken away for clarity.
Figure 4B:
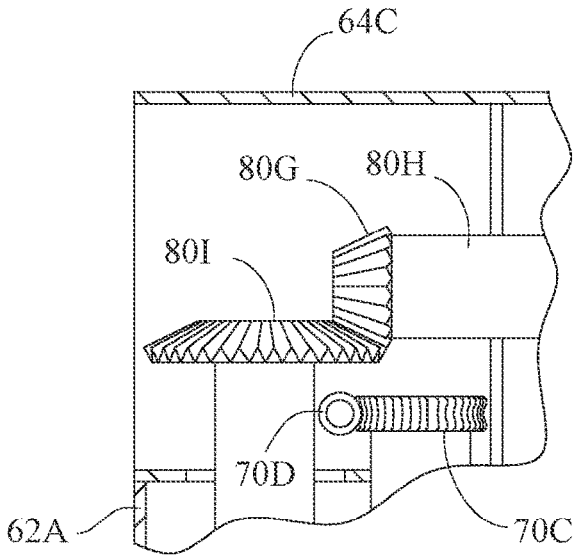
FIG. 4B-4C is a detailed view of 4A
Figure 4C:
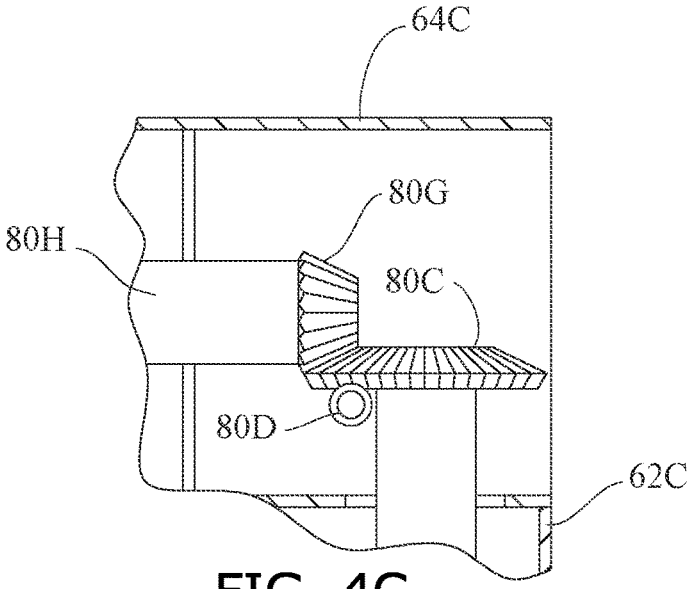
Figure 6:
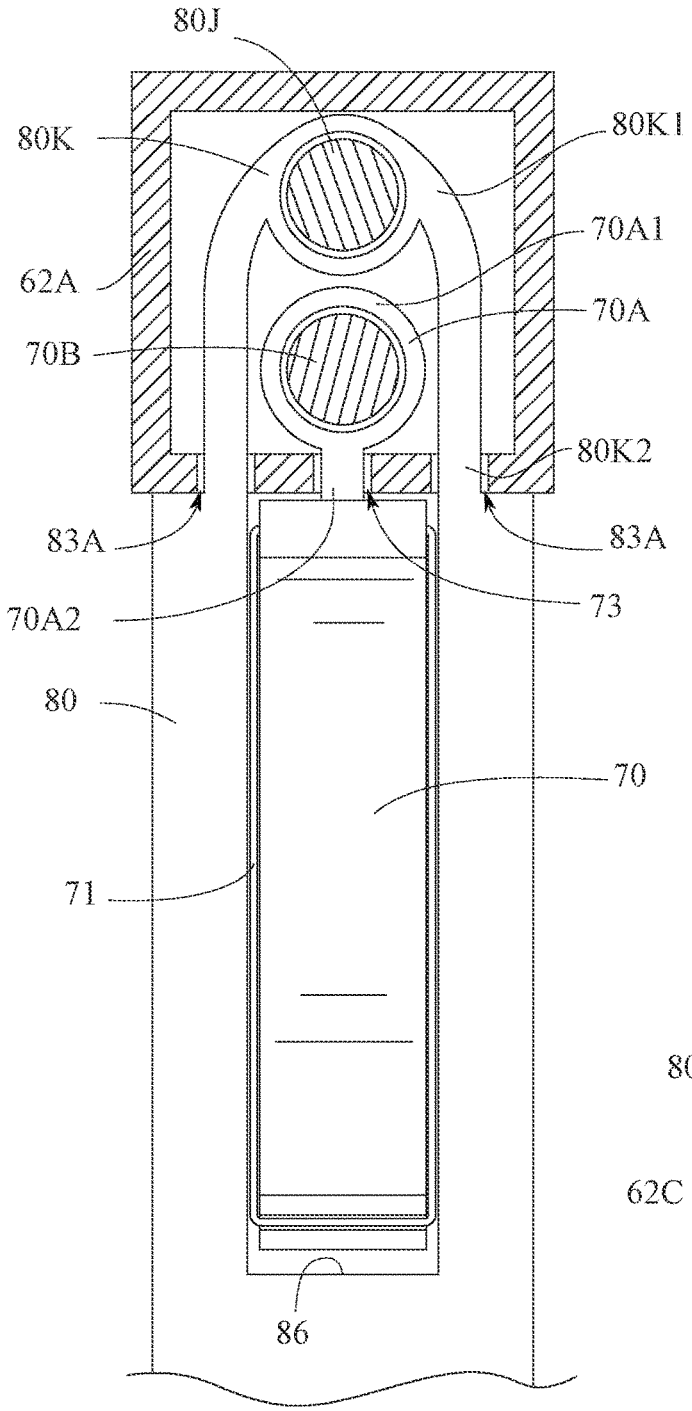
FIG. 6 is a detailed section view of an exemplary embodiment of the present invention, taken along line 6-6 in FIG. 3.
Figure 7:
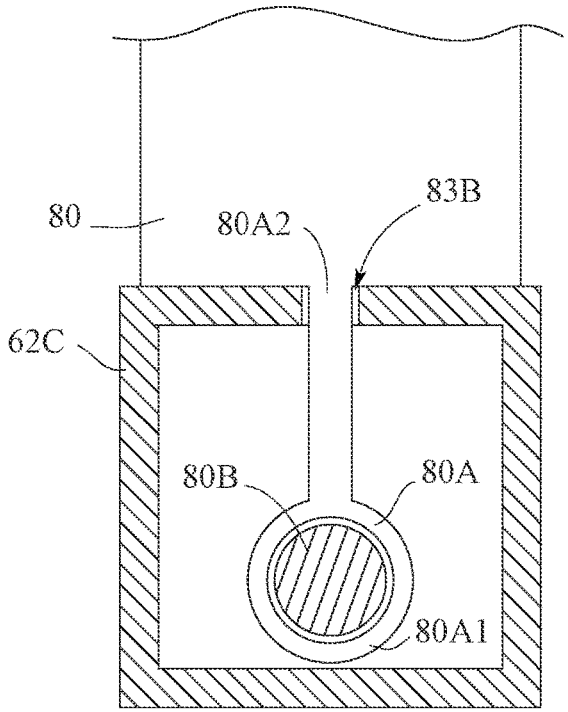
FIG. 7 is a detailed section view of an exemplary embodiment of the present invention, taken along line 7-7 in FIG. 3.

Two actuators 80B-J and 70B may be disposed in each vertical upright 62A-62D. The actuators 80B-J and 70B may be vertically oriented and in a parallel relationship relative to each other as they extend a substantial length of the respective vertical upright (between the distal end and the proximal end, adjacent the platform 30). Each actuator 80B-J and 70B operatively associates with an actuator interface 83A-B and 73, respectively, along an outer surface of the respective vertical upright, as illustrated in FIGS. 6 and 7. For each pair of longitudinal uprights, the respective actuator interfaces 83A-B and 73 face each other, as illustrated in FIG. 4A. The actuator interface interfaces 83A-B and 73 also extend a substantial length of the respective vertical upright.

In some, but not all, embodiments the actuators 80B-J and 70B may be worm screw and gear jacks with a translation nut or other forms of linear actuators. In some embodiments, the actuator interfaces 83A-B and 73 may be slots in the vertical upright that communicate with the respective worm screw and gear jacks with a translation nut linear actuator. The actuator interfaces 83A-B and 73 may be dimensioned and adapted to receive and operatively associate with a transition 80A-K and 70A respectively. The safety transition 80K may be U-shaped to be received and slide along safety bar actuator interface 83A and may be Loop-shaped 80A to be received and slide along safety bar actuator interface 83B. The support transition 70A may be Loop-shaped to be received and slide along a support actuator interface 73. The U-shape and Loop-shape complement each other and enable access to the respective actuators 80B-J and 70B that are spaced apart in a parallel orientation within the same vertical upright. Each transition 80A-K and 70A may be received in its respective actuator interface 83A-B and 73 by way of the distal end of the respective vertical upright.

Each transition 80A/80K and 70A has a distal end 80A1/80K1, 70A1 and a proximal end 80A2/80K2 and 70A2, respectively. The distal ends 80A1/80K1 and 70A1 may have an engagement element or the like dimensioned and adapted to operatively associate with the respective engagement element of the actuators 80B-J and 70B. In certain embodiments, wherein the actuators 80B-J and 70B are screw actuators, the distal ends 80A1/80K1 and 70A1 may provide a first gear arrangement that engages a second gear arrangement of the screw actuator so that rotation (clockwise or counterclockwise) of the non-travelling screw actuator causes the transition 80A/80K or 70A to travel linearly up or down the length of the screw actuator. The proximal ends of the transitions 80A2/80K2 and 70A2 may be removably or fixedly attached to the safety bar 80 and a bar support 70, respectively.

Figure 5:
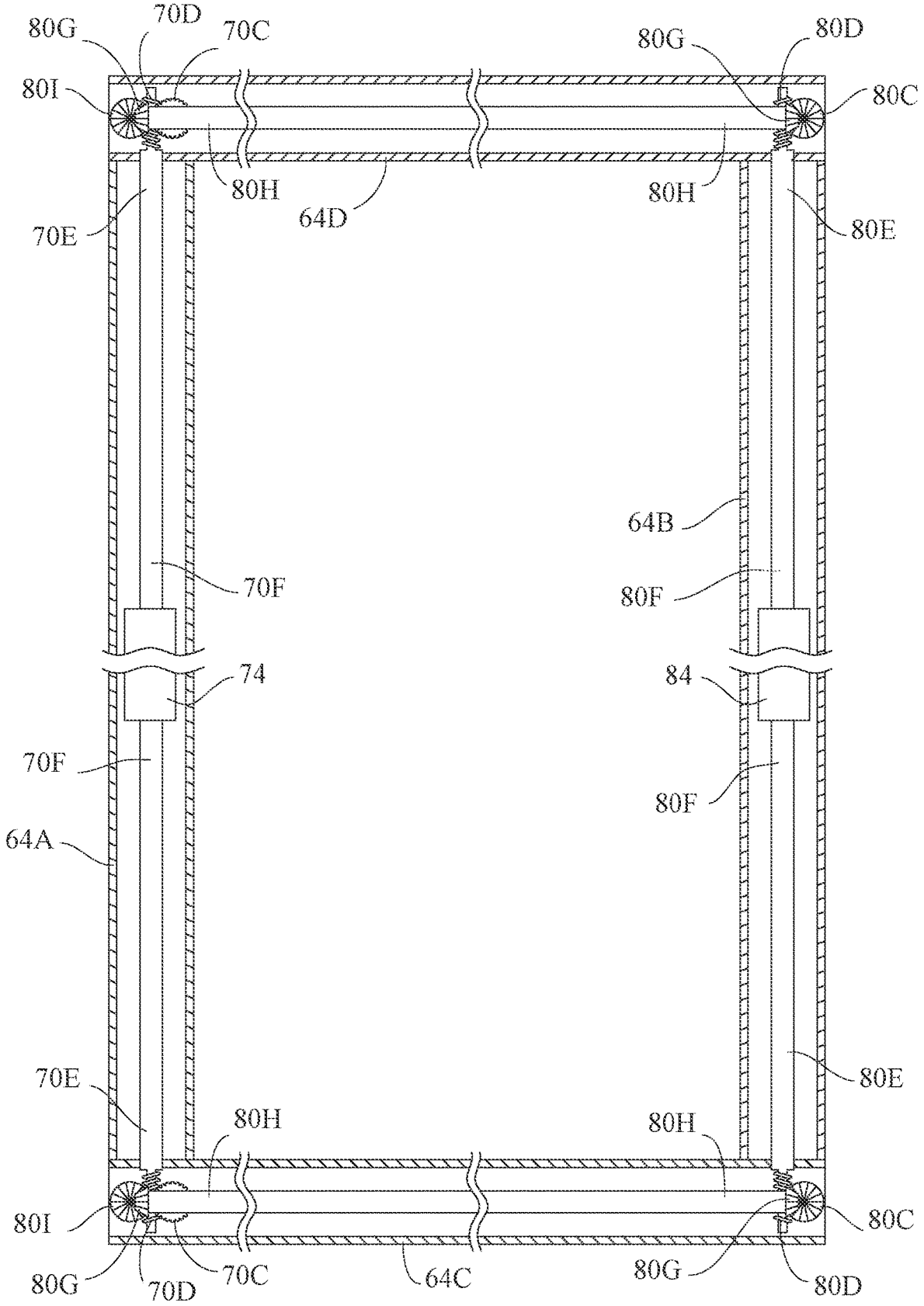
FIG. 5 is a top plan view of an exemplary embodiment of the horizontal members of the present invention, with parts broken away for clarity.

Referring to FIG. 5, the horizontal members 64A-64D may house a motor 74/84 (electric, pneumatic, or the like) with driving drive shafts 70F/80F that couple with the worm screw shafts 70E/80E, worm screws 70D/80D, worm gears 70C, worm/bevel gear 80C, bevel gears 80G, bevel shaft 80H, bevel gears 801, and actuators 80B-J and 70B in each vertical upright 62A-62D so that the actuators 80B-J and 70B rotate, which in turn selective moves (i.e., causes travelling of) the respective transitions 80A/80K or 70A. The present invention contemplates the actuators 80B and 70B (in a shared vertical upright) being independently rotatably relative to each other. It being understood that other methods to apply a force to lift the bar support 70 and safety bars 80 are contemplated by the present invention, such as block and tackle pulley systems, hydraulics, counterweights, other jack screw systems, linear actuators or belt systems. It is understood that the motor 74/84, drive shafts 70F/80F, worm screw shafts 70E/80E, worm screws 70D/80D, worm gears 70C, bevel shafts 80H, bevel gears 80G/801, worm/bevel gears 80C need not be housed in the horizontal members 64A-64D, they may be housed in the platform 30 as shown in FIG. 9, in the uprights 62A-D or any combination of locations housed on or inside the system 20. Additionally, the motor 74/84 and drive shafts 70F/80F could be separate from the system 20 or a motor 74/84 could couple and directly engage the actuators 80B-J, 70B to reduce the number of components for the system 20.

One embodiment of the present invention may have two motors 74/84 that independently actuate the bar supports 70 and safety bars 80 relative to each other. One motor 74 may cause the translation of the bar supports 70 by engaging the drive shafts 70F, that rotate the worm screw shafts 70E, that rotate the worm screws 70D, that engage the worm gears 70C, which rotates 70B clockwise or counterclockwise which in turn selective moves (i.e., causes travelling of) the respective transition 70A. One motor 84 may cause the translation of the safety bars 80 by engaging the drive shafts 80F, that rotate the worm screw shafts 80E, that rotate the worm screws 80D, that engage the worm/bevel gears 80C, which rotates the bevel gears 80G and bevel shaft 80H clockwise or counterclockwise, which rotates the bevel gears 801 clockwise or counter clockwise, to engage the rotation of 80B-J that in turn selective moves (i.e., causes travelling of) the respective transition 80A and 80K as illustrated in FIG. 4A-C and FIG. 5. It is understood that one motor can power the actuators 80B-J, 70 or scissor lifting actuators 90 by use of a more complex gear box system (not shown) in the system 20.

Referring the FIG. 4A, the present invention may embody a bar support 70 that connects to the proximal end of each bar support transition 70A. The bar support 70 may include but is not limited to J-hooks. The bar support 70 define a basket portion 72 for supporting a portion of the barbell 120. The basket portion 72 has a depth. A basket latch 71 may close an upper portion of the basket portion 72, thereby preventing a received portion of the barbell 120 from being lifted out of the basket portion 72. It should be clear that the bar support 70 may not be J-hooks, but can include any structure (e.g., flat, spherical, cylindrical, etc.) that can engage various fitness equipment (e.g., dumbbells, free weights, resistance bands, etc.) or portions of the human user themselves. Thus, the bar support 70 can be "universal". Additionally, it should be clear that the safety bar 80 may not be rectangular bars, but can include any structure (e.g., flat, spherical, cylindrical, etc.) that can engage various fitness equipment (e.g., dumbbells, free weights, resistance bands, etc.) or portions of the human user themselves for "spotting" or safety purposes. Thus, the safety bar 80 can be "universal".

The bar support 70 and the safety bar 80 vertically align (since they both connect to the same vertical uprights). The distal ends of each safety bar 80 may provide cavities 86 into which the depth of the basket portion 72 can nest. Note, that the safety bar 80 need not be in the nested condition for this to happen. Though when this does happen in the nested condition, then an upper portion of the basket portion 72 may be approximately flush with the upper surface of the platform 30 (as the basket portion 72 occupies space within the safety bar 80 so that, like the safety bar notch 82, the basket portion 72 may receive/engage a portion of a barbell 120 that is supported on the upper surface of the platform 30 and/or side actuating benches 40 and/or the safety bar 80.

The uprights 62A-D may also serve as a stop for the barbell 120 should the barbell roll up or down the platform 30 and/or the side benches 40 and/or safety bar 80. This may keep the barbell 120 from rolling off the system 20. The uprights 62A-D, safety bars 80 and the side actuating benches 40 may encompass (along with cameras 66, a computer 68, and the like, which are disclose in more detail below) a synergistic system to control the location of the barbell 120 on the system 20. That system may keep the barbell 120 from rolling of the system 20.

The actuating side benches 40 and safety bars 80 may also assist the lifter with a "lift off" from the bar supports 70 or back to the bar supports 70, should the lifter request it to do so. The central bench 50 may be used as a surface to squat on like a box for box squats. For that use of the system 20, the user would have the barbell 120 placed in the notch 82 that is raised by the safety bar 80 to the user's height to begin the squat and the central bench 50 actuated to the appropriate anthropometry of the user to squat to. The user would lift the weight off the notch 82 while facing the computer 68 to squat to the central bench 50. During the squat the notch 82 would be lowered by the safety bars 80 so that they would not get in the way of the user to squat to the central bench 50. Then when the user squats to the central bench 50 the user would stand back up while being spotted by the safety bars 80 and/or side actuating benches 40 until the barbell 120 is placed back in the notch 82 at the top of the squat.

The frame 60 may support cameras 66 and electrically connected computers 68 to facilitate command and control of the selectively movable safety bars 80, side actuating benches 40, central bench 50, adjustable bench 55 and bar supports 70. The computer 68 may have a display and user interface for further enabling the command and control. For instance, the computers 68 may be configured, based on the pixels captured by the connected cameras 66, to selective move the bar support 70 to provide the required spacing for the barbell 120 relative to a person recumbently disposed on the central actuating bench 50 for bench presses or other similar movements. As a default, the latitudinally opposing bar support 70 are kept in alignment.

It is understood that the cameras 66 may not be mounted on the uprights 62A-D, crossmembers 64A-D or the frame 60. The cameras 66 may be mounted on their own camera frame 100 as shown in FIG. 9 and/or mounted separate from the system 20. Additionally, it is understood that the computer 68 may be mounted elsewhere on or inside the system 20 such as but limited to on the camera frame 100 as shown in FIG. 9 and/or mounted separate from the system 20.

It is understood that there may be a combination of alternative configurations of the system 20. Such as but not limited to keeping the crossmembers 64A-D but moving the linear actuator motors, shafts, screws and gears to be housed inside the platform 30 or in the uprights 62A-D. Additionally, this includes changing the camera 66 placement locations, camera 66 angles that look up/down towards the lifter or platform 30, where the cameras 66 are focused to look on the system 20, camera mount 100 placement locations and the number of cameras 66.

It is understood that the side actuating benches 40 may be additionally modified to recess lower than the surface of the platform 30 to allow deficit movements such as a deficit deadlift and the like.

It is understood that the latches on the safety bar notch 81 and the bar support 70 may be additionally modified to electronically open and close by the computer or other electronic systems.

It is understood that all the linear actuating systems described in this application may be modified to be an all-manual system powered by the human user.

It is understood that when the barbell 120 is placed on the bar support 70 in the basket 72 or the safety bar notch 82 and secured by the latches 71 or 81, respectively, the barbell 120 may be prevented from moving out of those locations and/or from keeping the barbell 120 from rotating while secured to use the barbell 120 as a pull-up bar that is adjustable to the user's height by use of the actuating systems decried in this application.

Computer System Command and Control Applications

Figure 13:
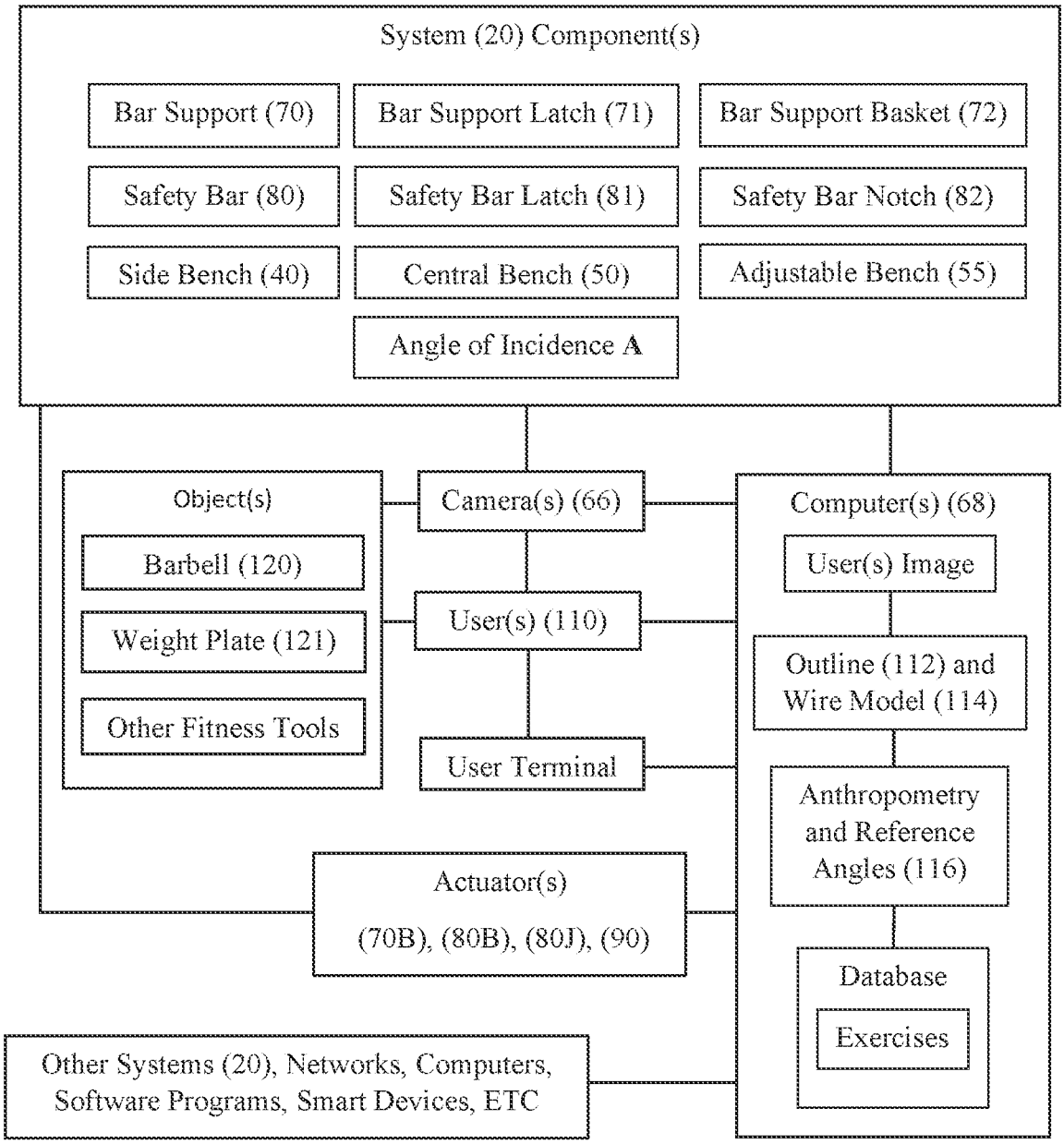
FIG. 13 is a schematic view of an exemplary embodiment of the present invention.

Referring to FIG. 13, the computer(s) 68 may assist the lifters in workout programming, exercise selection, counting and verifying repetitions of movement were properly executed in real time via use of the cameras 66. The computer(s) 68 may assist the lifter(s) in the loading/unloading of a barbell 120 via use of the cameras 66. The computer(s) 68 may assist in the transition, use, spotting, teaching, coaching/technique correction of the following movements and variations with a loaded or unloaded barbell 120 in real time via use of the cameras 66 (including lifting/lowering and repositioning of a loaded or unloaded barbell 120 to or from the platform 30 or side actuating benches 40 or central bench 50 or adjustable bench 55 or bar supports 70 or safety bars 80): Press; Bench Press; Squat; Deadlift; Clean; Jerk; Snatch: variations of those movements and the like.

The computer(s) 68 may execute voice commands and/or independently set the safety bars 80, the bar supports 70, the central actuating bench 50, adjustable bench 55 and side actuating benches 40 to different heights for better use and safety for each lifter based on their anthropometry.

Figure 10A:
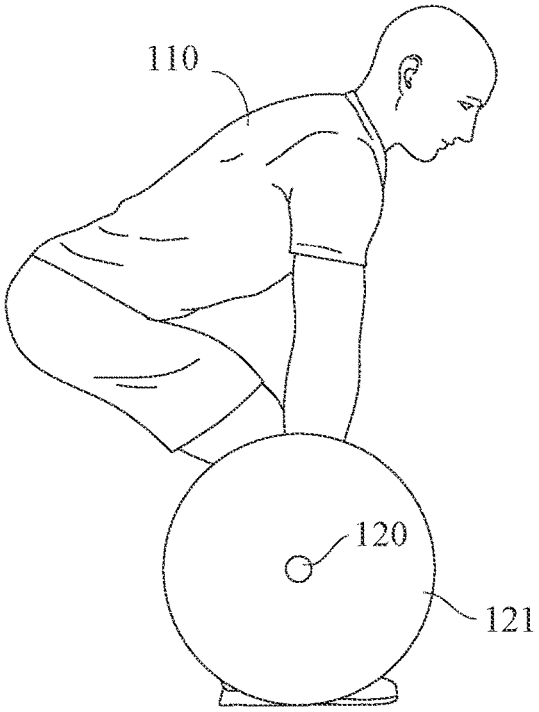
FIG. 10A is a side view of an exemplary embodiment of the present invention, illustrating a digital image of a user.
Figure 10B:
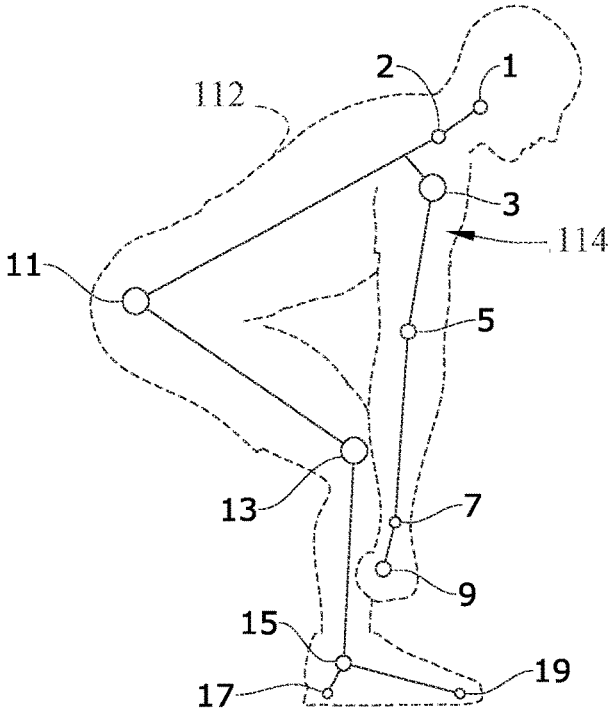
FIG. 10B is a schematic view of an exemplary embodiment of the present invention, illustrating a wireframe overlaid onto the digital image of the user of FIG. 10A.
Figure 10C:
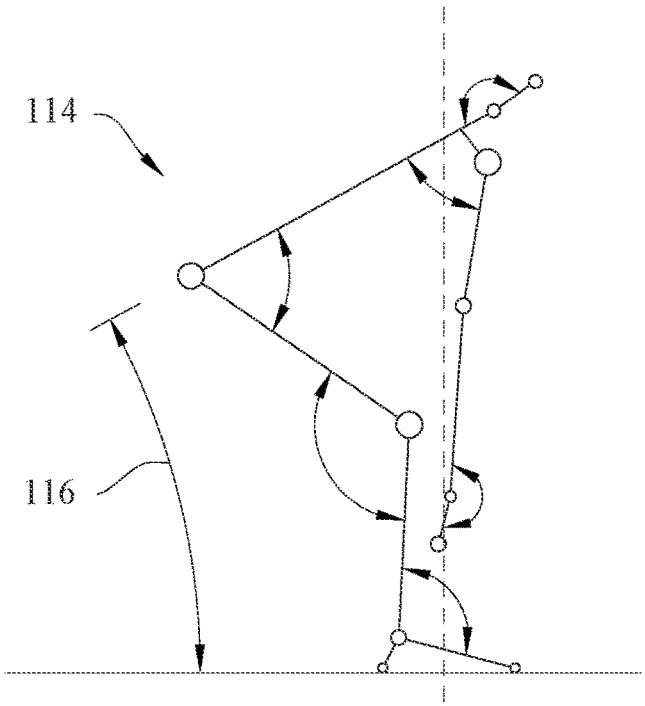
FIG. 10C is the schematic view of an exemplary embodiment of the present invention, illustrating the wireframe of FIG. 10B used for analysis.

The computer 68 may use the cameras 66 to help provide weight verification by line of sight of weights 121 and/or the barbell 120. Each weight 121 is of a different thickness, diameter and/or color and knows which weight 121 weighs a certain amount. The computer 68 may use the cameras 66 to help assist the transition, use, spotting, teaching, coaching/technique movement pattern correction by using the bodies reference angles 116 based on anthropometry as shown in FIG. 10A-C in real time. For example, the angle between the lifter's back 116 and the platform 30 can provide enough data if the lifter is setting their back correctly before the start of a deadlift. The computer 68 may use the cameras 66 to "see" the lifter/barbell that are linked up the computer 68 that controls the system 20 to better assist the lifter. The computer 68 may use cameras 66 to "see" if the bar latches/locks 71/81 are in use or not to help prevent the system 20 from operating if they are improperly used to prevent damage to the system 20.

Cameras 66 may be placed at the following locations relative to the frame 60: one front middle; one rear middle; two on the sides in the middle; and one on each side, whereby 360-degree visual coverage of the lifter and barbell 120 are captured. Cameras 66 may be hung down from mounts on the ceiling of the frame 60. The cameras 66 may be disposed approximately eight feet off the surface of the platform 30 when hanging from the ceiling mounts that are approximately nine feet from the surface of the platform 30. The cameras 66 may be in fixed and/or moveable positions. The cameras 66 may be oriented to look downward and towards the center of the platform 30.

The computer 68 may be configured to provide logistics support by knowing what load and position of the barbell 120 is on the system 20 as well as on other systems 20 in a network of systems 20, wherein the computer 68 can communicate to lifter(s) where to go next for their current and future lift(s) and what weight to use to minimize the que of the system 20. For example, if a user had a plurality of systems 20 within a few feet of each other with different/similar loads on each barbell 120 on each system 20 the computers 68 will calculate where each person should go and what to do based on their workouts and tell them that in real time to reduce the que on the system 20.

The system 20 may "talk" to lifters via Bluetooth or other wireless communication technology via earphones, speakers, or the like on the frame 60, other software applications or "smart" devices. One system 20 may "talk" to other system 20 or other "smart" devices via WIFI, LAN or Bluetooth in the network of system 20.

The system 20 may be capable of LAN, WIFI and/or ethernet wiring and/or being connected to the internet for live coaching by trainers, updates to the system 20 and/or transmit data to other computers 68, a central computer or data storage and processing systems. The system 20 may be plugged into a power outlet, use batteries or other power storage and retrieval systems, have USB outlets, antennas or receivers. The computer 68 may be configured to keep track of the wear and tear of the system 20 for engineering updates and spread the wear and tear amongst systems 20 in a network of systems 20.

The computer 68 may be configured to provide weight verification on the barbell 120 so that the lifter is using the correct weight and prevents misloading of the barbell 120. The computer 68 may be configured to provide advance lifting support by reducing the perceived load on the barbell 120 by providing an opposite force on the barbell 120. For example, a barbell 120 may weigh forty-five pounds but a lifter can only lift and lower thirty-five pounds on the bench press. So, an upward force of ten pounds can be applied, via the linear actuators 80B-J for the safety bars 80 and/or actuators 90 for the side actuating benches 40, to make the barbell 120 "weigh" thirty-five pounds.

The computer 68 may be configured to allow for the use of more advanced lifting techniques such as eccentric overload training. For example, the lifter puts three hundred and fifteen pounds on the barbell 120 for bench press but only can bench three hundred pounds. The lifter can lower the three hundred and fifteen pounds but when pressing the weight back up the system 20 can provide the fifteen or more pounds of force—via the linear actuators 80B-J for the safety bars 80 and/or the side actuating bench actuators 90 for the side actuating benches 40—necessary to help the lifter rack the weight.

The computer 68 may be configured to selective move and lock the central actuating bench 50, side actuating benches 40, adjustable bench 55, bar supports 70 and safety bars 80 for assisting the lifter in concentric, eccentric or isometric weight-lifting regimens.

The computer(s) 68 may facilitate a tilt function of side actuating benches 40 that may be used for repositioning the barbell 120 along the platform 30 or side actuating benches 40 or safety bars 80 as shown in FIG. 8. By tilting the side actuating benches 40 clockwise or counterclockwise the barbell 120 is going to roll in that direction with or without weight on the barbell 120. This tilt function may be controlled by a computer 68 that knows the degree of tilt of the side actuating bench 40. The degree of tilt may be changed by using one of the actuators 90 to raise or lower one part of the side actuating bench 40 more than the other part of the same side actuating benches 40 and thus a tilt is created. A computer 68 may know the position of the barbell 120 via use of the cameras 66 and may tilt the side actuating benches 40 to control the location of the barbell 120 via use of the actuators 90. Each platform portion or associated benches 40 can be independently controlled to tilt to greater control the rolling of the barbell 120 to position. Similarly, the platform 30 and side actuating benches 40 can be also used to help "catch" or "absorb" a dropped barbell 120 to help dampen the sound and keep the barbell 120 from bouncing away or towards the lifter(s).

The basket latch 71 and the notch latch 81 may be manually controlled by the lifter(s) and may visually verify their securement by use of the cameras 66 and the computer 68 display. The computer 68 may verify the use of the basket latch 71 and notch latch 81 by the cameras 66 so that no damage to the system 20 will occur if improperly used.

The computer(s) 68 may control all motors and actuators of the system 20 and cameras 66. The computer(s) 68 may also process and relay data to other machines, computers, devices or a central computer in the network. The computer(s) 68 may collect data on every lifter on weights used, movements executed, time spent unloading/loading the barbell, resting and time spent on each lift including warm up and work sets in real time. As well as positioning of the equipment on the system 20 when the system 20 is in use. The computer(s) 68 may also collect data on how long each lifter is in que and time spent entering, leaving, and getting prepared for the lift or any other data wanted by trainers, researchers or the users themselves.

The safety bars 80 with the notch 82 may give the system 20 the capability to perform as a mono-lift. For example, a person wants to squat two hundred and twenty-five pounds with the mono-lift function. They would load the barbell 120 to two hundred and twenty-five pounds while the barbell 120 is positioned in the notch 82. They would position themselves under the barbell 120 as needed for the squat and then start the squat by standing up and move the barbell 120 off the notch 82, the notch 82 may be lowered by the safety bars 80 controlled by the camera 66 and computer 68 system. Then the user would squat without having to move their feet into a new position. Then at the bottom of the repetition of the squat the safety bar 80 and notch 82 may be raised by the camera 66 and computer 68 system so that the lifter can rack the weight back into the notch 82 at the end of the repetition.

The safety bars 80 and side actuating benches 40 may complement each other. They may provide more lifting forces and different ways to spot/assist a lifter. The safety bars 80 may provide a "track" when raised slightly more than the platform 30 or side actuating benches 40 thus keeping the barbell 120 from rolling off the system 20.

Because self-locking worm screw and gear linear actuators 70B and 80B-J may be used for the uprights 62A-D and actuators 90, each height of the bar support 70, safety bar 80, side actuating benches 40, central bench 50, adjustable bench 55 is simultaneously self-locking. This makes the system safer in the event of power loss, weight dropping on the components and extends the life of the motors 74/84 and actuators 90 powering the system 20 by putting less stress on the motors 74/84 and actuators 90 when loads are moved, lifted, lowered or dropped on the system 20.

The computer 68 and camera 66 system may use the lifters anthropometry by approximations of the user's body to determine the correct reference angles and distances between joints and other parts of the human body for a lifter to configure themselves to lift the barbell 120, other weights or devices. As illustrated in FIG. 10A-C, the lifter 110 may have their image taken by the cameras 66 and simplified to an outline 112 and wire model 114 for analysis of and by use of the computer 68 to configure the user to lift the barbell 120 with proper technique or use other fitness tools. The points in FIG. 10B are numbered to portray a simple example of where some key locations/nodes but not all locations of the human body are for calculating reference angles and proper technique. Nodes 1 and 2 represent locations of the cervical spine C1 and C7 respectively and the rest of the numbers are odd numbered when viewed from the right to represent the right side of the user. The even numbers not shown represent the left side of the same location. Node 3 is the right shoulder joint and 4 would be the left shoulder joint. Node 5 is the right elbow and node 6 would be the left elbow, etc. Node 7 is the right wrist, node 9 is the center of the right hand, node 11 is the right hip joint, node 13 is the right knee, node 15 is the right ankle, node 17 is the right heel and node 19 is the right toes. The computer 68 and camera 66 system may approximate these locations to determine the distances between them and each other to finally calculate the lifters anthropometry and references angles for the lifts to execute with proper technique in real time.

The present invention contemplates a database of wireframe model exercise routines against which the computer(s) 68 may compare captured wireframe models to in order to make a determination of a proper or improper positioning of one or more of a user's body portions.

The voice commands by the computer 68 to the user may be in the voice of the user, a generic "robotic" voice or other voices such as but limited to their trainers or a celebrity.

The cameras 66 and computer 68 system may record the movements of a trainer or a user performing a workout in real time with which it can have users perform for their workout in real time for local or long-distance training on their own systems 20. The system 20 may help the users of said workout routine with coaching of those movements in real time.

The cameras 66 and computer 68 system may recognize other fitness tools such as dumbbells, exercise bikes, row machines, jump ropes or any other fitness tool and may train people how to use them the same way it would train people how to lift the barbell 120. This includes bodyweight movements.

The camera 66 and computer 68 system may "spot" the user via visual cues. For example, when the system 20 is configured for a user to bench press and the safety bars 80 and/or side actuating benches 40 are raised to a position slightly below the user on the central bench 50 such that if the barbell 120 is dropped, they may raise and contact the barbell 120 and not the user. For example, when the user is on the central bench 50 and takes the barbell 120 off the bar supports 70 the computer 68 and camera 66 system may know that first movement and position is the start and end of the movement. It may know the barbell 120 will touch the user's chest at the bottom of the movement before pressing the barbell 120 back to the initial position because the computer 68 might have a database of exercises and knows what to expect with that lift or other lifts or movements. While the user is performing the bench press and if they drop the barbell 120 intentionally, due to injury, muscle failure or can't press the weight of their chest or experience muscle failure during any other part of the movement or other reasons the camera 66 and computer 68 may "see" that and react by raising the safety bars 80 and/or side actuating benches 40 to contact the barbell 120 and assist the user to rack the weight back into the bar supports 70. This process may be very similar to how another human user would "spot" another lifter using visual ques or body language or voice commands. This includes the user using voice commands or body language such as saying "help" or shaking their head "no" to get the system 20 to assist the lifter. This spotting process is not limited to the bench press but any movement with which the safety bars 80 and/or side actuating benches 40 are needed to "spot" the user.

It is understood when the present invention is training users it may consider the users limitations such as but not limited to range of motion, previous or current injury(s), etc. for training purposes. It is understood when the barbell 120 becomes wedged in-between the bar supports 70 and safety bars 80 the system 20 may "see" that and prevent damage to the system 20. It is understood that the priority of the system 20 may be the health of the user and not damage to the system 20.

Platform, Bar Support, and Safety Bar Specifications

The following dimensions and specifications of the system 20 are given so the reader has a general sense of the relative size of the system 20. Many aspects of the system 20 may change. The system 20 may be significantly larger or smaller than what is specified. Platform 30 base dimensions may be approximately eight feet wide and approximately nine feet long, height of base is determined by space needed for scissor lifts and motors/actuators, drive shaft, support trusses etc. for the scissor lifting actuators 90 or other actuating devices, but overall, the ceiling (top surface of the crossmembers 64A-D) may be approximately nine feet from the surface of the platform 30.

The central actuating bench 50 supporting surface may be approximately ten inches wide and may be approximately forty-eight inches in length. The actuating bench 50 may extend to approximately twenty inches above the platform 30. The side actuating benches 40 may raise approximately five feet from the platform 30 and their supporting surface may be approximately twenty-eight inches wide and may be approximately one hundred and four inches in length.

The longitudinal spacing of the vertical uprights may be approximately one hundred inches. The latitudinal spacing of the vertical uprights may be approximately forty eight and one-half inches. The vertical uprights 62A-62D may be approximately nine feet in length. The safety bar 80 may be approximately two inches wide, 96 inches in length. The notches 82 may be approximately mid-length along the safety bar 80.

The motors 74/84, actuators 90, worm gears 70C, worm screws 70D/80D, bevel gears 80G/801, worm/bevel gear 80C, drive shafts 70F/80F, worm screw shafts 70E/80E, bevel shafts 80H and connecting mechanisms may also be housed in the platform 30 or reengineered to be in the uprights 62A-D. It is understood that the motor 74/84 and drive shafts 70F/80F may be separate from the system 20. The wiring for the cameras 66 and computers 68 may be inside the horizontal members 64A-64D as well as the vertical uprights 62A-62D or inside the platform 30. The system 20 may have a terminal where lifters can manually control aspects of the system 20. The terminal may be located on the outward facing side of one vertical upright approximately five feet off the platform 30.

A method of using the present invention may include the following. The system 20 disclosed may be provided. A lifter would place the barbell 120 on the bar supports 70, in the basket 72 without additional weight on the barbell 120. The barbell 120 is secured with the basket latch 71 so the barbell 120 does not come off the bar supports 70 while adjusting the barbell 120 height or loading the barbell 120 with weight by way of operating the linear actuators 70B via the computer 68 command and control functionality. To adjust the barbell 120 height the user would selectively operate the motor 74 accordingly. After adjusting the barbell 120 height and loading weight on the barbell 120 the basket latches 71 may be moved to an unlocked condition so the lifter can lift the weight. Also, the lifter-user may lift, by way of the actuated bar supports 70, the barbell 120 that is supported by the platform 30 and/or side actuating bench 40 through utilizing the nested position of the safety bar 80 and its cavities 86, which is occupied by the basket portion 72 of the bar support 70.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A lifting rack system, comprising:

a plurality of uprights;

at least one linear actuator housed in each upright;

a motor powering each linear actuator;

for each upright, an interface extends along a length of the upright;

for each linear actuator, a support transition operatively associates a bar support and the at least one linear actuator so that the bar support is selectively movable along the interface;

a platform, wherein a proximal end of each upright connects to the platform; and the platform having a first actuating bench disposed between the plurality of uprights, wherein the motor is operatively associated with the first actuating bench in such a way that the first actuating bench is selectively movable between an extended position and a retracted position, wherein the retracted position an upper surface of the first actuating bench is approximately flush with an upper surface of the platform.

2. The lifting rack system of claim 1, the platform having at least one second actuating bench disposed outside of the plurality of uprights, wherein the motor is operatively associated with the at least one second actuating bench in such a way that the second actuating bench is selectively movable between an extended position and a retracted position, wherein the retracted position an upper surface of the second actuating bench is approximately flush with an upper surface of the platform.

3. The lifting rack system of claim 2, wherein the at least one linear actuator includes a support actuator and a safety actuator oriented in parallel, wherein the support actuator operates with the support transition, wherein the safety actuator operatively associated with a safety bar so that the safety bar is selectively movable between a nested condition and an elevated condition.

4. The lifting rack system of claim 3, wherein the platform provides a recess dimensioned to receive the safety bar in the nested condition so that an upper portion of the safety bar is flush with the upper surface of the platform.

5. The lifting rack system of claim 4, further comprising a safety transition operatively associated the safety actuator and a distal end of the safety bar.

6. The lifting rack system of claim 5, wherein the safety transition is U-shaped, and wherein the support transition is loop shaped.

7. The lifting rack system of claim 5, wherein a distal end of the safety bar has a cavity dimensioned to slidably receive the bar support so that the bar support is at least substantially received in the cavity when the safety transition and the support transition are at a shared elevation relative to the platform.

8. The lifting rack system of claim 4, wherein each bar support has a basket, and comprising a basket latch connected with the basket in such a way to pivot between a closed position and an open position.

9. The lifting rack system of claim 8, wherein safety bar has a notch, and wherein each notch has notch latch connected with the notch in such a way to pivot between a closed position and an open position.

10. The lifting rack system of claim 9, further comprising a plurality of cross members interconnecting each distal end of the plurality of uprights; and the motor disposed in the cross members.

11. The lifting rack system of claim 10, further comprising a plurality of cameras and at least one computer connected with the plurality of uprights or the plurality of cross members.

12. The lifting rack system of claim 2, wherein each second actuating bench is operatively associated with a bench actuator in such a way as to be selectively movable across a plurality of tilted orientations, wherein an upper surface of the second actuating is lockable in each tilted orientation defining an angle of incident relative to the platform, wherein the angle of incident selectively ranges between zero and forty-degrees.

13. A lifting rack system, comprising:

a platform;

at least one image capturing device coupled with at least one computer operatively associated with the lifting rack system, wherein the at least one computer is configured to provide a feedback regarding a user of the lifting rack system performing an exercise, wherein the feedback is a wireframe model of said user during the exercise, wherein the wireframe model includes a plurality of nodes, wherein each node represents a body portion of said user, wherein the at least one computer is configured to determine one or more reference angles between a respective body portion and the platform during the exercise;

a plurality of uprights supported by the platform;

at least one linear actuator housed in each upright;

a motor powering each linear actuator;

for each upright, an interface extends along a length of the upright;

for each linear actuator, a support transition operatively associates a bar support and the at least one linear actuator so that the bar support is selectively movable along the interface; and a fitness tool operatively associated with one or more of the bar supports, wherein the computer is configured to access a database of exercise routines and, based in part on a first comparison between the database and the wireframe model, selectively activate the motor to move at least one linear actuator.

14. The lifting rack system of claim 13, further comprising:

an actuating bench disposed between the plurality of uprights, wherein the motor is operatively associated with the actuating bench in such a way that the actuating bench is selectively movable between an extended position and a retracted position, wherein the computer is configured to, based in part on a second comparison between the database and the wireframe model, selectively activate the motor to move the actuating bench.

* * * * *